US005382057A

United States Patent [19]

Richter

[11] Patent Number: 5,382,057

[45] Date of Patent: Jan. 17, 1995

[54] MANIFOLD FOR A FRONT-DISCHARGE FLUID END RECIPROCATING PUMP

[75] Inventor: Travis L. Richter, Duncan, Okla.

[73] Assignee: Halliburton Company, Duncan, Okla.

[21] Appl. No.: 112,490

[22] Filed: Aug. 26, 1993

Related U.S. Application Data

[62] Division of Ser. No. 943,342, Sep. 10, 1992, Pat. No. 5,299,921.

[51] Int. Cl.[6] ..... F16L 35/00; F16L 55/00; F16B 23/00

[52] U.S. Cl. ..... 285/39; 285/354; 411/405

[58] Field of Search ..... 411/402, 405, 427; 285/39, 354

[56] References Cited

U.S. PATENT DOCUMENTS

| | | | |
|---|---|---|---|
| 139,550 | 6/1873 | Cronin | 285/150 X |
| 1,546,596 | 7/1925 | Mader . | |
| 2,103,944 | 12/1937 | Gullborg | 411/402 X |
| 2,733,664 | 2/1956 | Saalfrank . | |
| 2,841,092 | 7/1958 | Whiteman et al. . | |
| 2,931,313 | 4/1960 | Hughes . | |
| 3,373,695 | 3/1968 | Yohpe . | |
| 3,801,234 | 4/1974 | Love et al. | 417/454 |
| 3,817,663 | 6/1974 | Zehner | 417/569 |
| 3,930,756 | 1/1976 | Brugeman | 417/537 |
| 4,099,894 | 7/1978 | Indra | 417/499 |
| 4,395,060 | 7/1983 | Lapham | 285/39 |
| 4,477,236 | 10/1984 | Elliott | 417/454 |
| 4,508,133 | 4/1985 | Hamid | 137/68 R |
| 4,520,837 | 6/1985 | Cole et al. | 137/68 R |
| 4,613,158 | 9/1986 | Ekman | 285/39 X |
| 4,729,401 | 3/1988 | Raines | 137/512 |
| 4,771,801 | 9/1988 | Crump et al. | 137/68.1 |
| 4,790,732 | 12/1988 | Yamatani | 417/539 |
| 4,919,456 | 4/1990 | Wong | 285/39 |
| 5,020,953 | 6/1991 | Wada | 411/405 |
| 5,073,096 | 12/1991 | King et al. | 417/454 |

FOREIGN PATENT DOCUMENTS

| | | | |
|---|---|---|---|
| 281547 | 6/1952 | Switzerland | 417/537 |

*Primary Examiner*—Neill R. Wilson

*Attorney, Agent, or Firm*—Stephen R. Christian; Neal R. Kennedy

[57] ABSTRACT

A manifold for a front-discharge fluid end reciprocating pump. The manifold comprises tubular portions which are connected to ports on the pump by threaded engagement of a plurality of nuts. The manifold has a center portion and at least one branch portion which intersects the center portion. Another tubular portion having a ported end is in communication with the center and branch portions and provides an outlet for the manifold. At least one nut on the manifold is a standard nut having lugs extending therefrom adjacent to an outer surface of the nut. A special nut is used on at least one of the connections and has lugs extending adjacent to the inner surface thereof. The lugs on the special nut have a longitudinal thickness less than the nuts on the standard nut. In this way, the nuts may be engaged with closely adjacent ports on the pump without interference of the lugs on the nuts with one another.

8 Claims, 3 Drawing Sheets

MANIFOLD FOR A FRONT-DISCHARGE FLUID END RECIPROCATING PUMP

This is a divisional of copending application Ser. No. 07/943,342 filed on Sep. 10, 1992, now U.S. Pat. No. 5,299,921.

BACKGROUND OF THE INVENTION

1. Field of the Invention

This invention relates to high pressure reciprocating plunger-type and piston-type pumps used in the petroleum industry, and more particularly, to a manifold for a front-discharge pump used in manifolding discharge valves positioned substantially coaxially with respect to the plungers in the pump. The invention also relates to a special nut used on the manifold.

2. Description of the Prior Art

It is common practice in the petroleum industry to employ high pressure plunger-type pumps in a variety of field operations relating to oil and gas wells, such as cementing, acidizing and fracturing, among others. An example of such a high pressure pump is the Halliburton Services HT-400 Horizontal Triplex Pump manufactured by Halliburton Services of Duncan, Okla., the assignee of the present invention. These pumps are frequently used in pumping two-phase slurries. Two-phase slurries are those in which solid particles (the "solid phase") are suspended in a liquid (the "liquid phase"). A problem with pumping such two-phase slurries is that the solid phase particles can separate cut of the carrier liquid and can collect in valves, elbows, and in the fluid ends of the high pressure pumps in the system.

In the pumps, these particles tend to become packed ahead of the pump plunger or piston. This can result in sudden overpressurizing of the fluid in the pump with resulting damage to one or more of the plungers, connecting rods, crankshaft, fluid end, valves or other parts of the pump drive train.

Prior solutions to the overpressurizing problems are disclosed in U.S. Pat. Nos. 4,508,133 to Hamid and 4,520,837 to Cole et al., both assigned to the assignee of the present invention. These inventions comprise a protective cover assembly having a shear disc surrounded by an annular outer portion, mounted in a cylinder of the fluid end of the plunger-type high pressure pump. When a predetermined force is generated by the plunger in the cylinder, such as in an overpressure situation, the shear disc of the cover is sheared and is propelled outwardly against the plug. In turn, this forces the impact disc against an edge of a circular recess in the outer end of the retainer. The impact disc, in shearing against the recess edge, safely dissipates the kinetic energy of the shear disc, while the pressure in the cylinder vents to the atmosphere, avoiding damage to the fluid end of the pump, the plunger, connecting rod, crankshaft, etc. A problem with these devices is that the sheared disc is subjected to cyclic Loading. Cyclic stress causes fatigue and premature failure of the disc around the thin arcuate wall may occur even at low pump pressures. Another problem is that the thin area around the arcuate portion does not leave much thickness for corrosion allowance, and thus may fail prematurely when corrosion is present. A further problem with previous apparatus is that the shear disc is expensive to fabricate, and machining may leave machine marks which act as stress risers and compound the fatigue problem already mentioned.

An apparatus which solves the fatigue problem is disclosed in U.S. Pat. No. 4,771,801 to Crump et al., also assigned to the assignee of the present invention. In this invention, a cover with a convex or domed center portion is used and is adapted for buckling away from the pump plunger when the pressure in the pump exceeds a predetermined level. The convex portion buckles when excessive force is transmitted from the plunger through any packed solid particles, allowing the packed particles to be pushed through vent passages.

Even though the apparatus of Crump et al. greatly reduces the risk of fatigue failure over Hamid and Cole et al., all three have two additional problems. First, once failure has occurred, the pump must be taken out of service immediately upon rupture of the protective cover. Secondly, a large quantity of the pump fluid can be spilled out of the pump when the cover ruptures. This limits the suitability of the apparatus for pumping some hazardous fluids. Also, the use of such shear discs obviously add somewhat to the operating costs of the pump in which they are employed.

In U.S. patent application Ser. No. 07/595,348 to King et al., assigned to the assignee of the present invention, a pump fluid end is disclosed which solves the problems of the prior art by providing a pump in which a discharge valve is placed coaxially with the pump plunger or piston so that, if solid particles become packed ahead of the plunger, the force is transmitted through the particles to the discharge valve, pushing the valve open. This allows the packed particles to be pushed through the valve opening into the discharge passage. During this process, the pump may remain in use, and all fluids remain contained within the pump and its associated plumbing. The pressure containing envelope of the pump contains no designed "weak links" which present the possibility of failing and spilling fluid, as is possible in the other prior art.

A possible problem with using the apparatus of King et al. with conventional piping is that there may still be fluid flow problems in the discharge piping system. The present invention provides a front discharge manifold for the front discharge pump of King et al. The manifold is designed so that fluid flow therethrough will be smoother, thereby causing fewer pressure spikes. The reduction in such pressure spikes reduces the cyclic loading on the discharge valves and minimizes the fatigue resulting therefrom. The manifold also allows connection of multiple discharge valves even when the cylinders, and thus the discharge valves, are in close proximity to one another. By such a manifold, separate piping for each discharge valve is no longer necessary which reduce the costs and down time related to servicing.

Discharge valves which are close to one another may be manifolded because of a special nut which allows multiple connections to be made in a straight line while not interferring with nuts on adjacent cylinders. Basically, the invention allows more connections in a smaller space.

SUMMARY OF THE INVENTION

The present invention includes a manifold apparatus for a front discharge pump having a plurality of ports. The manifold apparatus comprises a first tubular portion having an end adapted for engagement and communication with a first port of the pump, a second tubular portion having an end adapted for engagement and communication with a second port of the pump, and another tubular portion having a ported end. The second tubular portion is in communication with the first tubular portion, and the tubular portion having the ported end is in communication with the first and second tubular portions.

In the preferred embodiment, the first tubular portion is substantially straight, and the second tubular portion has a curved section such that the tubular portion intersects the first tubular portion at substantially a right angle. The tubular portion having the ported end is preferably substantially coaxial with the first tubular portion.

Generally, the apparatus further comprises a first nut disposed around the end of the first tubular portion and adapted for locking engagement with the pump adjacent to the first port and a second nut disposed around the end of the second tubular portion and adapted for locking engagement with the pump adjacent to the second port. Each of the nuts has an outer side facing generally away from the pump and an inner side facing generally toward the pump. The first nut comprises a plurality of lugs extending therefrom adjacent to one of the outer and inner sides thereof, and the second nut comprises a plurality of lugs extending therefrom adjacent to the opposite of the outer and inner sides thereof as the lugs on the first nut, such that the lugs on the first nut do not interfere with the lugs on the second nut. In the illustrated embodiment, the second nut is a standard nut having lugs adjacent to the outer side thereof, and the first nut is a special nut of the invention having lugs adjacent to the inner side thereof. The first nut has a greater number of lugs than the second nut, and the lugs on the first nut preferably have a longitudinal thickness less than the longitudinal thickness of the lugs on the second nut.

The special nut itself may be said to be generally adapted for connecting a tube to a ported member and comprising an annular ring portion adapted for positioning around the tube adjacent to an end thereof. The ring portion comprises an internally threaded surface adapted for threading engagement with the ported member, an outer surface facing away from the ported member when the ring portion is attached thereto, and an inner surface facing toward the ported member when the ring portion is attached thereto. The lugs extend radially outwardly from the ring portion adjacent to the inner surface and therefore longitudinally spaced from the outer surface. That is, the inner side of the lugs are substantially coplanar with the inner surface of the ring portion. The lug may also be said to have an outer side longitudinally closer to the inner side of the ring portion than the outer side of the ring portion. The internally threaded surfaces adjacent to the inner surface of the ring portion, and the nut further comprises an annular flange extending radially inwardly with respect to the ring portion adjacent to the outer surface of the ring portion.

In an embodiment in which the pump is a triplex pump having three ports, the first tubular portion is a center tubular portion connected to a center one of the ports, and the second tubular portion is a branch tubular portion connected to an outer one of the ports adjacent to the center one of the ports. The apparatus further comprises another branch tubular portion connected to the other outer one of the ports adjacent to the center one of the ports. The apparatus additionally comprises a cross portion where the branch tubular portions intersect the tubular portion on opposite sides thereof. The tubular portion having the ported end is also in communication with the cross portion.

Numerous objects and advantages of the invention will become apparent as the following detailed description of the preferred embodiment is read in conjunction with the drawings which illustrate such preferred embodiment.

DESCRIPTION OF THE PREFERRED EMBODIMENT

Figure 1:
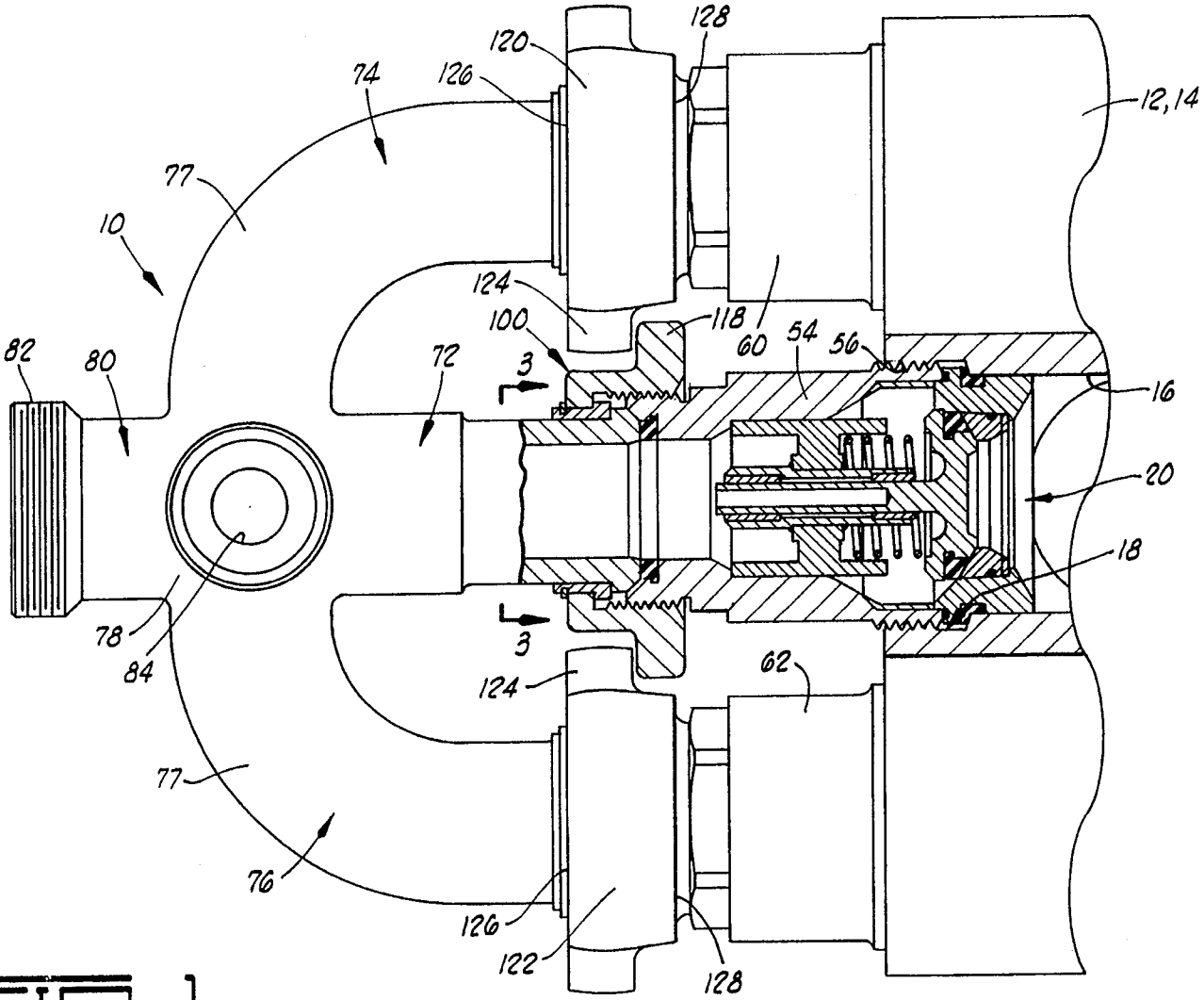
FIG. 1 illustrates the front discharge manifold of the present invention in which the manifold is connected to a plurality of ports of a multiple plunger pump.

Referring now to the drawings, and more particularly to FIG. 1, the front discharge manifold of the present invention is shown and generally designated by the numeral 10. Manifold 10 is shown in an operating position connected to a reciprocating plunger-type pump 12. Pump 12 is shown as a front discharge type such as that disclosed in previously discussed U.S. patent application Ser. No. 07/595,348 to King et al.

Cylinder 14 defines a plurality of plunger bores 16 therein, only one of which is shown in FIG. 1. In the illustrated embodiment of pump 12, the pump is a triplex pump, and cylinder 14 has three such plunger bores 16. However, the invention is not intended to be limited to a manifold used with three cylinders.

At the longitudinally outer end of each plunger bore 16 in cylinder 14 is a discharge valve pocket 18. An outlet or discharge valve assembly 20 is disposed in each valve pocket 18.

Figure 2:
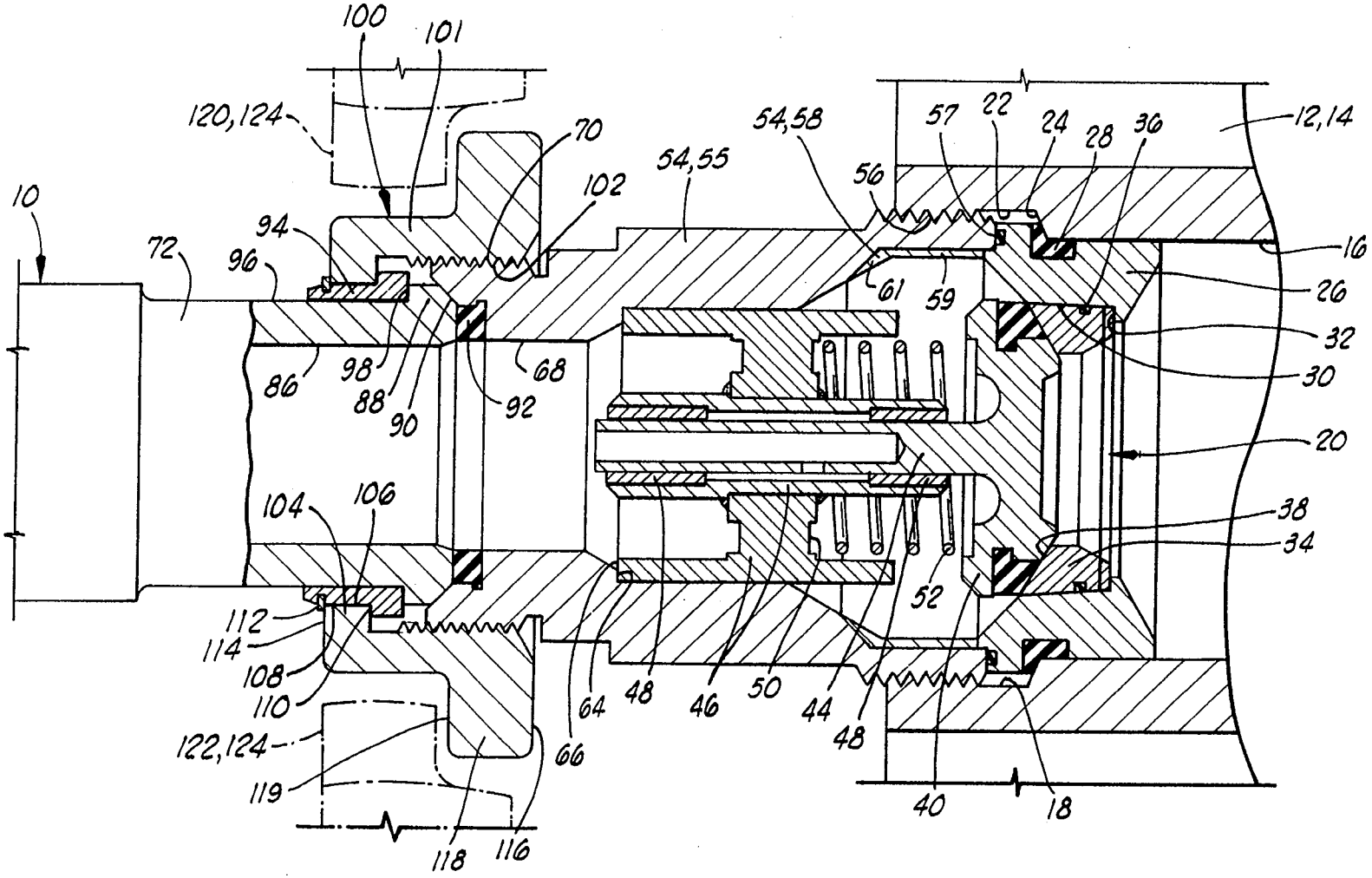
FIG. 2 is an enlargement of the cross-sectional area shown in FIG. 1.

Referring now to FIG. 2, the details of valve pocket 18 and discharge valve 20 will be discussed. Valve pocket 18 is generally formed by a bore 22 with an outwardly facing shoulder 24 at one end thereof.

Outlet valve 20 is adjacent to a seat carrier 26, an outer portion of which being adjacent to bore 22 and an inner portion of which extending into plunger bore 16. A sealing means, such as a valve gasket 28, provides sealing engagement between seat carrier 26 and cylinder 14 adjacent to shoulder 24. Seat carrier 26 defines a tapered bore 30 therein with an annular shoulder 32 at one end thereof.

Outlet valve assembly 20 may comprise a valve seat 34 which is disposed in tapered bore 30 of seat carrier 26 adjacent to shoulder 32. A sealing means, such as an O-ring 36, provides sealing engagement between seat 34 and seat carrier 26. Seat 34 has a taper 28 therein.

A valve member 40 is positioned adjacent to taper 38 in the seat 34, and a sealing means, such as valve insert 42, provides sealing engagement between valve 40 and seat 34 when discharge valve assembly 20 is in the closed position shown in FIG. 2. Valve 40 has an elongated guide portion 44 which is slidably supported in a sleeve-like bushing retainer 46 by a pair of bushings 48. Bushing retainer 46 is shown as a multi-piece weldment, but can easily be cast or otherwise formed as an integral part.

Bushing retainer 46 has an annular shoulder 50 thereon. A valve string 52 is disposed between shoulder 50 and valve 40, and thus provides a biasing means for biasing valve 40 toward the closed position shown.

A retainer means, such as a valve retainer 54, is used for holding outlet valve 20 in place. Valve retainer 54 has an outer portion 55 which is connected to cylinder 14 at threaded connection 56. Thus, valve retainer 54 bears against a longitudinally outer end of seat carrier 26. A sealing means, such as O-ring 57, provides sealing engagement between valve retainer 54 and seat carrier 26. It will be seen that seat carrier 26 is thus clamped in place by valve retainer 54.

Valve retainer 54 may comprise a wear sleeve 58 which is positioned within outer portion 55. Wear sleeve 58 has a substantially cylindrical portion 59. A beveled portion 61 extends longitudinally away from cylindrical portion 59 and radially inwardly with respect to the cylindrical portion. Wear sleeve 58 thus provides a wear surface within valve retainer 54 adapted for resisting wear due to solid particles in the two-phase slurry flowing through pump 12.

Valve retainer 54 extends outwardly from cylinder 14 as seen in FIGS. 1 and 2. In the three cylinder embodiment, there are two additional valve retainers 60 and 62, as seen in FIG. 1.

Referring again to FIG. 2, valve retainer 54 has a shoulder 64 therein that bears against a longitudinally outer end 66 of bushing retainer 46. It will thus be seen that bushing retainer 46 is held in the position shown in FIG. 2 by spring 52 and shoulder 64 of valve retainer 54. In other words, outlet valve assembly 20 is clamped in place.

The outer end of valve retainer 54 defines an outlet port 68 therein. Valve retainer 54 also has an externally threaded surface 70 at the outer end thereof. This ported and externally threaded outer end of valve retainer 54 thus may be said to be a ported member forming the outlet of pump 12.

Referring again to FIG. 1, manifold 10 comprises a central tube or first tubular portion 72 which are joined to two branch tubes or second tubular portions 74 and 76 at a cross portion 78. Branch tubes 74 and 76 each have a curved portion 77 so that they intersect center tube 72 at substantially a right angle.

An outlet tube or other tubular portion 80 also extends from cross portion 78 and is substantially coaxial with, and may be considered a portion of central tube 72. Outlet tube 80 has an externally threaded surface 82 thereon which is adapted for being threadingly engaged with an outlet line of a kind known in the art. Outlet tube 80 may also be referred to as a tubular portion having a ported end. Cross portion 78 also has a transversely disposed side port 84 which is adapted for receiving instrumentation, such as a pressure transducer (not shown).

Referring again to FIG. 2, central tube 72 defines a central opening 86 therethrough which is coaxial with outlet 68 in valve retainer 54. An inner end 88 of central tube 82 engages a chamfer 90 defined in the outer end of valve retainer 54. A sealing means, such as gasket 92, provides sealing engagement between central tube 72 and valve retainer 54. A plurality of ring segments 94 are disposed around an outer surface 96 of central tube 72 and bear against a shoulder 98 defined on the outer side of inner end 88 of the central tube. See FIGS. 2 and 3.

Special retainer nut 100 of the present invention is used to attach central tube 72 to valve retainer 54. Nut 100 has a ring portion 101 with an internally threaded surface 102 which is threadingly engaged with threaded outer surface 70 of valve retainer 54. A radially extending flange portion 104 of nut 100 defines a bore 106 therethrough which is adapted for close relationship to an outer surface 108 of ring segments 94. Flange 104 engages and clamps against a shoulder 110 on each of ring segments 94. Thus, when nut 100 is threaded onto valve retainer 54, flange portion 104 will clamp ring segments 94 and thus inner end 88 of central tube 72 to the valve retainer. After connection of nut 100, a retainer ring 112 is installed which engages ring segments 94 and outer surface 114 of nut 100, thus helping to hold the ring segments in place. Nut 100 has an inner surface 116 on the opposite side thereof from outer surface 114.

Figure 3:
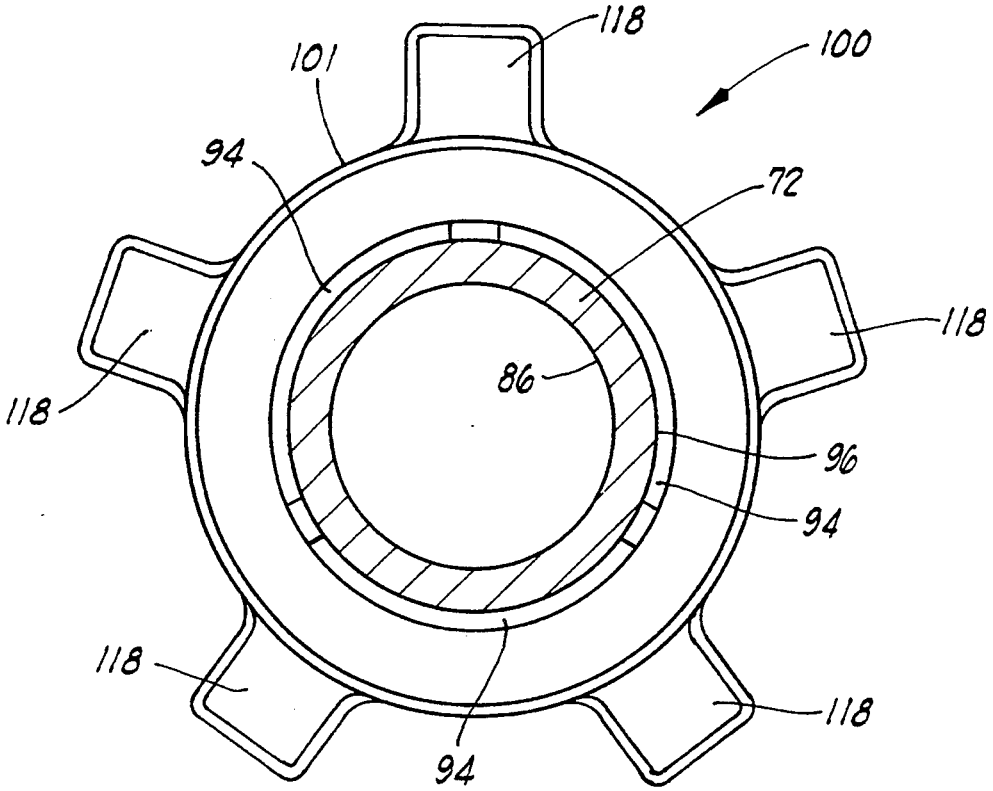
FIG. 3 is a cross section taken along lines 3—3 in FIG. 1.

Referring now to FIGS. 2 and 3, a plurality of lugs 118 extend radially outwardly from ring portion 101 of nut 100. In the embodiment shown, five such lugs are used, although the invention is not intended to be limited to any specific number of lugs. However, nut 100 has a greater number of lugs 118 than the typical standard nut which will be described further herein.

As best seen in FIG. 2, lugs 118 extend from inner surface 116 of ring portion 101 of nut 100. Thus, the inner surface of lugs 118 may be said to be substantially coplanar with inner surface 116 of ring portion 101 of nut 100. An outer surface 119 of each lug 118 is longitudinally spaced from outer surface 114 of ring portion 101 of nut 100. Preferably, outer surface 119 of each lug 118 is spaced further from outer surface 114 of ring portion 110 of nut 100 than from inner surface 116. That is, the longitudinal thickness of each lug 118 is less than the longitudinal thickness of a lug on a standard nut. This allows nut 100 to be installed without the interference of lugs 118 with the lugs on standard nuts as will now be described.

Referring again to FIG. 1, a standard nut 120 connects branch tube 74 of manifold 10 to valve retainer 60 in substantially the same manner as nut 100 connects central tube 72 to valve retainer 54. Similarly, another standard nut 122, substantially identical to nut 120, connects branch tube 76 of manifold 10 to valve retainer 62, again in substantially the same manner as nut 100 connects central tube 72 to valve retainer 54.

Standard nuts 120 and 122 have a plurality of lugs 124 extending radially outwardly therefrom. Typically the standard nut 120 or 122 has three such lugs 124. It will be seen that lugs 124 extend along outer surface 126 of nuts 120 and 122. In other words, lugs 124 are longitudinally spaced from inner surface 128 of nuts 120 and 122. Thus, it will be seen that lugs 124 on standard nuts 120 and 122 are on the opposite sides thereof from lugs 118 on nut 100. Thus, when manifold 10 is installed on pump 12, as shown in FIG. 1, lugs 124 do not interfere with lugs 118. Because of the small amount of space available between nuts 120 and 122, access to nut 100 for tightening and untightening thereof is somewhat difficult. For this reason, a greater number of lugs 118 are used on nut 100 than lugs 124 necessary on nuts 120 or 122.

Operation of the Invention

In normal pump operation, fluid is pumped through cylinders 14 and raised in pressure by the advance of the plunger (not shown) toward outlet valve assembly 20. The fluid is then discharged from bore 16 through outlet valve assembly 20. Because outlet valve assembly 20 is substantially coaxial with a pump plunger, any particles which have been separated from the slurry being pumped are simply pushed through the outlet valve into outlet port 68, and then into manifold 10. Thus, the apparatus allows for solid particle separation in the pump slurry while eliminating the problems associated with prior art pumps with rupture discs, in the same way as the front end discharge pump disclosed in previously cited U.S. patent application Ser. No. 07/595,348.

Fluid is pumped through outlet ports 68 in valve retainers 54, 60 and 62 and thus into central tube 72, branch tube 74 and branch tube 76, respectively, of manifold 10 and then through outlet tube 80 into the system piping. Fluid flows substantially straight from outlet 68 of valve retainer 54 through central tube 72, and there are no fluid restrictions after the fluid enters manifold 10. The fluids pumped through curving branch tube 74 and 76 intersect the fluid flowing through central tube 72 at cross portion 78. Although the fluid then must turn from branch tube 74 and 76 toward outlet tube 80, the tubing size and substantially full openings through the tubing of manifold 10 do not result in any significant problems with regard to restriction of any separated particle in the slurry. In other words, there are no small openings in manifold 10 which would cause the particles to clog up the system and they will flow freely into outlet tube 80.

It can be seen, therefore, that the manifold for a front discharge reciprocating pump of the present invention, and the special nut included in the manifold, are well adapted to carry out the ends and advantages mentioned, as well as those inherent therein. While a presently preferred embodiment of the apparatus has been shown for the purposes of this disclosure, numerous changes in the arrangement and construction of parts may be made by those skilled in the art. All such changes are encompassed within the scope and spirit of the appended claims.

What is claimed is:

1. A nut set for connecting closely adjacent tubes to a ported member, said nut set comprising:

a first nut comprising:

an angular ring portion adapted for positioning around one of said tubes adjacent to an end thereof, said ring portion comprising:

an internally threaded surface adapted for threading engagement with said ported member;

an outer surface facing away from said ported member when said ring portion is attached thereto; and an inner surface facing toward said ported member when said ring portion is attached thereto; and a lug extending from said ring portion adjacent to said outer surface and longitudinally spaced from said inner surface; and a second nut comprising:

an annular ring portion adapted for positioning around another of said tubes adjacent to an end thereof, said ring portion of said second nut comprising:

an internally threaded surface adapted for threading engagement with said ported member;

an outer surface facing away from said ported member when said ring portion of said second nut is attached thereto; and an inner surface facing toward said ported member when said ring portion of said second nut is attached thereto; and a lug extending from said ring portion of said second nut adjacent to said inner surface of said second nut and longitudinally spaced from said outer surface of said second nut and also longitudinally spaced from said lug on said first nut such that there is no interference therewith.

2. The nut set of claim 1 wherein said lug on said second nut has an inner side thereof substantially coplanar with said inner surface of said ring portion of said second nut.

3. The nut set of claim 1 wherein said lug on said second nut has an outer side longitudinally closer to said inner side of said ring portion of said second nut than said outer side of said ring portion of said second nut.

4. The nut set of claim 1 wherein said lug on said second nut is one of five angularly spaced lugs.

5. The nut set of claim 1 wherein said internally threaded surface of said second nut forms a portion of said inner surface of said ring portion of said second nut; and further comprising an annular flange extending radially inwardly with respect to said ring portion of said second nut adjacent to said outer surface of said ring portion of said second nut.

6. The nut set of claim 1 wherein:

said lug on said first nut is one of a plurality of angularly spaced lugs; and said lug on said second nut is one of a plurality of angularly spaced lugs.

7. The nut set of claim 6 wherein the number of lugs on said second nut is greater than the number of lugs on said first nut.

8. The apparatus of claim 7 wherein there are five lugs on said second nut and three lugs on said first nut.

* * * * *